US006703551B2

(12) United States Patent
Ueshima et al.

(10) Patent No.: US 6,703,551 B2
(45) Date of Patent: Mar. 9, 2004

(54) MUSICAL SCALE RECOGNITION METHOD AND APPARATUS THEREOF

(75) Inventors: Hiromu Ueshima, Shiga (JP); Shuhei Kato, Shiga (JP)

(73) Assignee: SSD Company Limited, Shiga (JP)

( * ) Notice: Subject to any disclaimer, the term of this patent is extended or adjusted under 35 U.S.C. 154(b) by 37 days.

(21) Appl. No.: 10/098,531

(22) Filed: Mar. 18, 2002

(65) Prior Publication Data

US 2002/0170414 A1 Nov. 21, 2002

Related U.S. Application Data

(60) Provisional application No. 60/324,538, filed on Sep. 26, 2001.

(30) Foreign Application Priority Data

May 17, 2001 (JP) ..... 2001-147448

(51) Int. Cl.[7] ..... G10H 7/00
(52) U.S. Cl. ..... 84/616; 434/307 A
(58) Field of Search ..... 84/607, 608, 616, 84/619, 654, 657; 434/307 A

(56) References Cited

U.S. PATENT DOCUMENTS 5,557,056 A 9/1996 Hong et al.
5,565,639 A 10/1996 Bae
5,621,182 A 4/1997 Matsumoto
5,719,344 A 2/1998 Pawate
5,960,373 A * 9/1999 Fukuda et al.

* cited by examiner

*Primary Examiner*—Jeffrey Donels
(74) *Attorney, Agent, or Firm*—Arent Fox Kintner Plotkin & Kahn, PLLC

(57) ABSTRACT

A musical scale recognition apparatus includes an analog/digital converter and a processor, and can determine by the processor how close an input analog audio signal is to a musical scale of a musical tone to be recognized by repeatedly performing a calculation of a cumulative value As to find a coefficient of a Fourier sine series of the audio signal on the basis of a frequency f and digital data D, a cumulative value Ac to find a coefficient of a Fourier cosine series of the audio signal on the basis of the frequency f and the digital data D, and a frequency power spectrum effective value A of the audio signal on the basis of the cumulative value As and the cumulative value Ac, wherein the digital data into which the input analog audio signal is converted by the analog/digital converter is D, the frequency (musical scale) of the musical tone to be recognized is f, and a current time is t. At this time, A is a value which shows how close the input audio signal is to the musical sound to be recognized, and it is shown that the larger the value A becomes, the closer the both sides are.

26 Claims, 12 Drawing Sheets

MUSICAL SCALE RECOGNITION METHOD AND APPARATUS THEREOF

This application claims the benefit of provisional application No. 60/324,538 filed on Sep. 26, 2001.

BACKGROUND OF THE INVENTION

1. Field of the Invention

The present invention relates to a musical scale recognition method and an apparatus thereof, and more specifically, to a musical scale recognition method and an apparatus thereof for comparing an input audio signal with a predetermined musical note.

2. Description of the Prior Art

Such a kind of a conventional musical scale recognition apparatus made measurements of a frequency component employing a Fast Fourier Transformation (FFT) in regard to an input audio signal, and carried out a musical scale recognition on the basis of the measurement result thereof.

However, there needed to be a microprocessor or a DSP (digital signal processor) with a high processing capability in order to analyze all frequency components included in the audio signal in real time because the Fourier transformation had to be done at high speed.

SUMMARY OF THE INVENTION

Therefore, a primary object of the present invention is to provide a musical scale recognition method and an apparatus thereof that even a microprocessor with a low processing capability can perform a musical scale recognition in real time.

A first musical scale recognition method according to the present invention, comprises following steps of (a) converting an input analog audio signal into digital data D by sampling the audio signal at constant intervals C; (b) deriving sin ωt and cos ωt (ω is an angular velocity in correspondence to an observed frequency f) based upon the observed frequency f and a time t; (c) calculating a cumulative value As to find a coefficient of a Fourier sine series by performing an operation of an equation (1); (d) calculating a cumulative value Ac to find a coefficient of a Fourier cosine series by performing an operation of an equation (2); (e) calculating a frequency power spectrum effective value A by performing an operation of an equation (3); (f) evaluating a component of the frequency f included in an analog audio signal on the basis of the numeric value A; and (g) renewing the time t by performing an operation of an equation (4).

$$As \leftarrow As + D \cdot \sin \omega t \quad (1)$$

$$Ac \leftarrow Ac + D \cdot \cos \omega t \quad (2)$$

$$A \leftarrow \sqrt{As^2 + Ac^2} \quad (3)$$

$$t \leftarrow t + C \quad (4)$$

A second musical recognition method according to the present invention, comprises following steps of (a) converting an input analog audio signal into digital data D by sampling the audio signal at constant intervals C; (b) deriving sin ωt and cos ωt (ω is an angular velocity in correspondence to an observed frequency f) based upon the observed frequency f and a time t; (c) a calculating a cumulative value As to find a coefficient of a Fourier sine series by performing an operation of the above equation (1); (d) calculating a cumulative value Ac to find a coefficient of a Fourier cosine series by performing an operation of the above equation (2); (e) calculating a frequency power spectrum effective value A by performing an operation of a below equation (5); (f) evaluating a component of the frequency f included in the analog audio signal on the basis of the numeric value A; and (g) renewing the time t by performing an operation of the above equation (4).

$$A \leftarrow As^2 + Ac^2 \quad (5)$$

A first musical recognition apparatus according to the present invention, comprises an analog/digital converting means which converts an input analog audio signal into a digital data D by sampling the audio signal at constant intervals C; a deriving means which derives sin ωt and cos ωt (ω is an angular velocity in correspondence to an observed frequency f) based upon the observed frequency f and a time t; a first operating means which calculates a cumulative value As to find a coefficient of a Fourier sine series by performing an operation of an equation (1); a second operating means which calculates a cumulative value Ac to find a coefficient of a Fourier cosine series by performing an operation of an equation (2); a third operating means which calculates a frequency power spectrum effective value A by performing an operation of an equation (3); an evaluating means which evaluates a component of the frequency f included in the analog audio signal on the basis of the numeric value A; and a renewing means which renews the time t by performing an operation of above equation (4).

A second musical recognition apparatus according to the present invention, comprises an analog/digital converting means which converts an input analog audio signal into a digital data D by sampling the audio signal at constant intervals C; a deriving means which derives sin ωt and cos ωt (ω is an angular velocity in correspondence to an observed frequency f) based upon the observed frequency f and a time t; a first operating means which calculates a cumulative value As to find a coefficient of a Fourier sine series by performing an operation of the above equation (1); a second operating means which calculates a cumulative value Ac to find a coefficient of a Fourier cosine series by performing an operation of the above equation (2); a third operating means which calculates a frequency power spectrum effective value A by performing an operation of the above equation (5); an evaluating means which evaluates a component of the frequency f included in the analog audio signal on the basis of the numeric value A; and a renewing means which renews the time t by performing an operation of the above equation (4).

A third musical scale recognition apparatus according to the present invention, comprises a BGM reproducing means which reproduces a karaoke BGM on the basis of musical score data; musical score data storing means which stores musical score data and musical scale data having an exemplary melody for singing included in synchronous with the musical score data; a reading means which reads the musical scale data from the musical score data storing means at a time t; a setting means which sets a frequency of the musical scale data read by the reading means to an observed frequency f; a musical scale recognition means which performs a musical scale recognition by using any one of the above musical scale recognition methods; and an outputting means which outputs an evaluation result by the evaluating means.

A fourth musical scale recognition apparatus according to the present invention, comprises, a BGM reproducing means which reproduces a karaoke BGM on the basis of musical score data; a musical score data storing means which stores musical score data and musical scale data having an exemplary melody for singing included in synchronous with the musical score data; a reading means which reads musical scale data from the musical score data storing means at a time t; a setting means which sets a frequency of the musical scale data read by the reading means to an observed frequency $f_0$, a frequency of a musical scale one octave below the musical scale data read by the reading means to an observed frequency $f_1$, and a frequency of a musical scale one octave above the musical scale data read by the reading means to an observed frequency $f_2$; a musical scale recognition means which carries out a musical scale recognition by using the above described musical scale recognition methods; and an outputting means which outputs an evaluation result by the evaluation means.

A fifth musical scale recognition apparatus according to the present invention, comprises a musical scale recognition means which sequentially carries out a musical scale recognition of an analog audio signal by using any one of the above musical scale recognition methods; a comparing means which compares a changing pattern of the musical scale recognized by the musical scale recognition means with a predetermined musical phrase; and a first operating means which performs a predetermined operation brought into correspondence with this relevant musical phrase when the changing pattern of the musical scale recognized by the musical scale recognition means becomes coincident with the predetermined musical phrase as a result of a comparison by the comparing means.

A sixth musical scale recognition apparatus according to the present invention, comprises a musical note data storing means which stores musical scale data of each musical note of a musical phrase; a pointer which points one of musical note data included in the musical note data storing means; a musical note data reading means which reads the musical scale data of the musical note pointed by the pointer from the musical note data storing means; a setting means which sets a frequency of the musical scale data read by the musical note data reading means to an observed frequency f; a musical scale recognition means which sequentially performs a musical scale recognition of an analog audio signal by using any one of the above described musical scale recognition methods; a comparing means which compares a degree of a frequency component of the frequency f included in the analog audio signal with a predetermined threshold value; a pointer manipulating means which, as a result of a comparison by the comparing means, increments the pointer when the degree of the frequency component of the frequency f included in the analog audio signal is larger than the predetermined threshold value and points at the musical scale data of the musical note at the forefront of the musical phrase by the pointer when the degree of the frequency component of the frequency f included in the analog audio signal is less than the predetermined threshold value; and a first operating means which performs a predetermined operation brought into correspondence to the relevant musical phrase when a value of the pointer exceeds a position of the musical scale data of the musical note at the end of the musical phrase.

In the first invention, provided that digital data having the input analog audio signal converted by an analog/digital converter is D, a frequency (musical scale) of a musical sound to be recognized is f, and a current time is t, calculations are made as to a cumulative value As to find a coefficient of a Fourier sine series of the audio signal on the basis of the frequency f and the digital data D, a cumulative value Ac to find a coefficient of a Fourier cosine series of the audio signal on the basis of the frequency f and the digital data D, a frequency power spectrum effective value of the audio signal on the basis of the cumulative value As and the cumulative value Ac. Then, it is evaluated to what extent the component of the observed frequency f is included in the analog audio signal on the basis of the numeric value A.

In a preferred embodiment, the numeric value A is evaluated after the input analog audio signal is corrected in correspondence to a level of an amplitude of the input analog audio signal.

In a further preferred embodiment, there exist a plurality of the observation frequencies ($f_0, f_1 \ldots, f_{N-1}$: N indicates the number of units of the frequencies to be simultaneously observed), and it is evaluated to what extent the component of the respective observation frequencies is included in the analog audio signal.

In the second invention, a level of consistency between the singing voices and an exemplary melody is evaluated in such a manner that singing voices sung along a karaoke BGM are subjected to a musical scale recognition on the basis of the exemplary melody for a singing.

More specifically, the BGM is reproduced on the basis of the musical score data, and the voices in tune with the BGM are input. The musical score data includes the musical scale data, i.e. the exemplary melody for singing in synchronous with the musical score data. When the BGM of the time t is being reproduced, the musical scale data at the time t is read from the musical score data.

Then, a musical scale recognition is applied to the singing voices at the time t on the basis of the frequency f of the read-out musical scale data, and evaluations are applied to an extent of the component of the frequency f included in the singing voices, i.e. an extent of consistency between the singing voices and the melody. It is possible to appropriately make a music scale recognition even though a reproduction pitch of the karaoke BGM is changed because the musical scale data is in synchronous with the musical score data.

There are cases of being sung on a musical scale one octave below or above the exemplary melody for singing. Therefore in the third invention, the musical scale recognition is applied to the singing voices sung along the BGM on the basis of a melody one octave below and above the exemplary melody for singing. In regard to the musical scale recognition, the musical scale recognition method is adopted as claimed in any of claims 1 to 4.

In the fourth invention, the musical scale recognition of the analog audio signal is successively applied in order to determine whether or not the analog audio signal is coincident with a predetermined musical phrase. Upon being coincident, a predetermined operation previously brought into correspondence to the relevant musical phrase is performed. In regard to the musical scale recognition, a musical scale recognition method is adopted as claimed in any of claims 1 to 4.

In a preferred embodiment, it is determined whether or not every single musical note in the musical phrase is included in the analog audio signal, and once it is determined a first sound is included as a result of the musical scale recognition, it is then determined whether or not a second note is further included. If and when the sound of any musical note is not included in the analog audio signal, the musical scale recognition is once again performed to determine whether or not the first sound is included in the analog audio signal. Subsequently, in a musical phrase including musical notes in N units, it is determined that the analog audio signal is coincident with the relevant musical phrase if and when it is determined that an N-th sound is included in the analog audio signal.

It is noted that when the musical scale recognition is applied to the analog audio signal by the N-th sound of the musical phrase, a musical scale recognition of the analog audio signal in correspondence to the N-th sound is performed during the length of musical note of the N-th sound.

In a further preferred embodiment, when the analog audio signal is coincident with the predetermined musical phrase, a code previously brought into correspondence to the relevant musical phrase is transmitted by blinking an infrared light-emitting element, for example.

In addition, a device which has received the transmitted code causes a light-emitting element, e.g. LED to blink in a pattern previously brought into correspondence to the code, and output from the speaker an audio signal having a content brought into correspondence to the code, and so forth on.

According to the present invention, a musical scale recognition of the input voices is performed by a simple processing, i.e. comparing a specific frequency component expected to be input with the input voices.

Therefore, it is possible to implement a device which carries out a musical scale recognition in real time by using a microprocessor with a low processing capability.

The above described objects and other objects, features, aspects and advantages of the present invention will become more apparent from the following detailed description of the present invention when taken in conjunction with the accompanying drawings.

BRIEF DESCRIPTION OF THE DRAWINGS

FIG. 1(A) shows a front surface, and FIG. 1(B) shows a rear surface;

DETAILED DESCRIPTION OF THE PREFERRED EMBODIMENTS

[First Embodiment]

Figure 1:
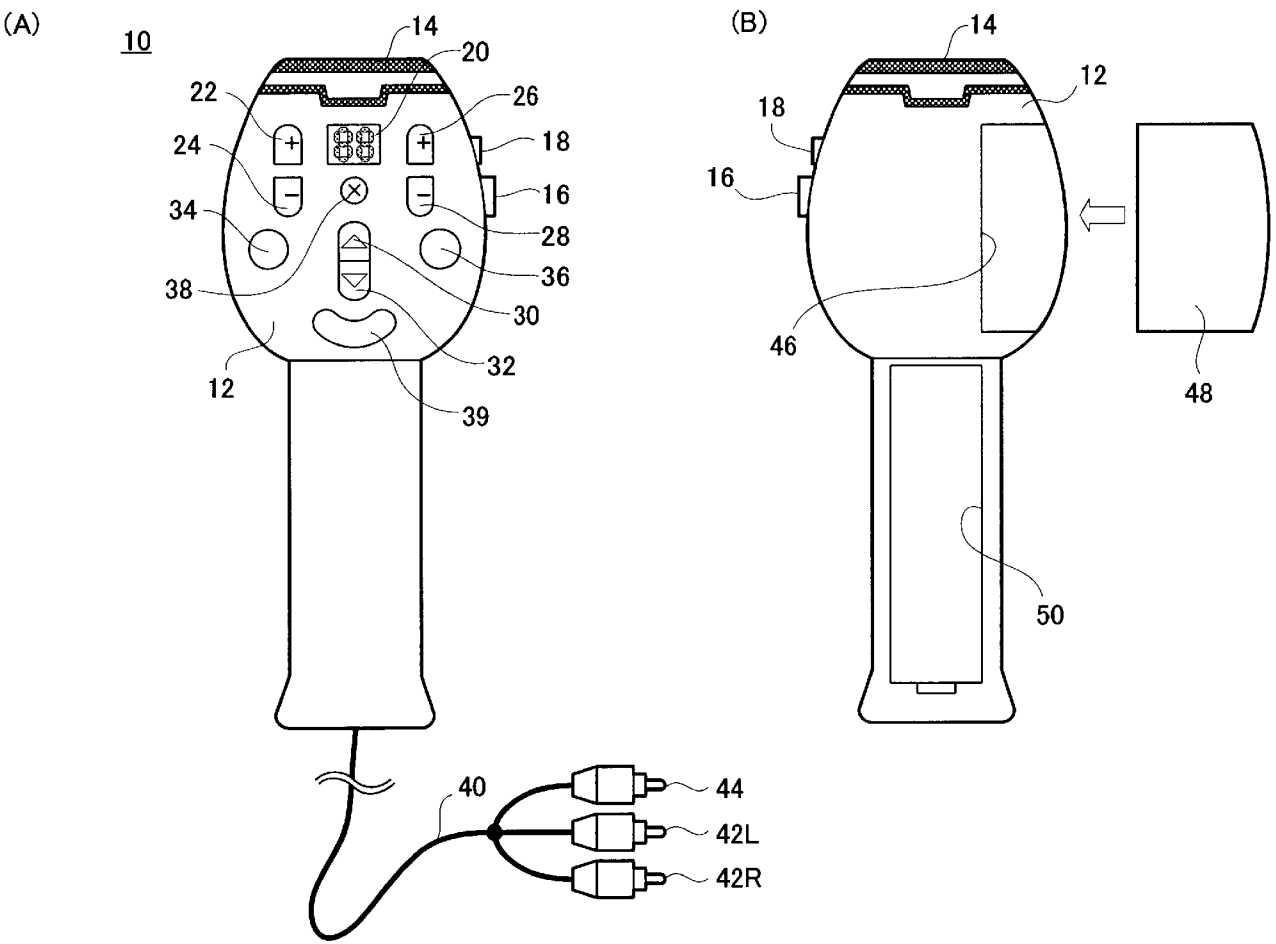
FIG. 1 is an illustrative view showing whole structure of one embodiment of the present invention.

Referring to FIG. 1, a karaoke device with built-in microphone 10 as a musical scale recognition apparatus in this embodiment includes a body 12 having an egg-shaped upper portion and a cylindrical lower portion, and a microphone 14 is mounted at an upper end of the egg-shaped portion of the body 12.

On an upper portion of the body 12, i.e. the egg-shaped portion, a power switch 16 and a reset switch 18 are provided. The power switch 16 is a switch for turning on/off a power, and the reset switch 18 is for resetting a whole process including selected music numbers.

Furthermore, a display 20 formed of a two-digit-seven-segment LED is provided on the egg-shaped portion, and on a left side that sandwiches the display 20 tempo control keys 22 and 24 are provided in an aligned fashion in a vertical direction, and on a right side BGM volume control keys 26 and 28 are provided in an aligned fashion in a vertical direction. The display 20 is utilized to show a music number selected by a user. The tempo control keys 22 and 24 are keys for increasing or decreasing a reproduction speed (tempo) of a karaoke or BGM. The BGM volume control keys 26 and 28 are keys to increase or decrease a reproduced sound magnitude (volume) of the karaoke or BGM.

Music selection/pitch control keys 30 and 32 are provided at a center, slightly lower portion of the egg-shaped portion of the body 12. The music selection/pitch control keys 30 and 32 are utilized to increment or to decrement the music number, and also utilized to raise or lower a karaoke pitch frequency, i.e. a musical key in tune in accordance with the user's tone one key by one key, for example.

An echo mode selection key 34 is provided at a left of the music selection/pitch control keys 30 and 32 and below the tempo control keys 22 and 24 on the egg-shaped portion of the body 12. The echo mode selection key 34 is utilized to selectively set an echo time (delay time) in an echo mode. In this embodiment, it is possible to set echo mode 1, echo mode 2 and echo mode 3 and the echo time is set as "small", "medium" and "large", respectively.

A voice effect mode selection key 36 is provided at a right of the music selection/pitch control keys 30 and 32 and below the BGM volume control keys 26 and 28 on the egg-shaped portion of the body 12. The voice effect mode selection key 36 can set voice effect mode 1, voice effect mode 2 and voice effect mode 3 in this embodiment. The voice effect mode 1 is a mode for processing voices so as to raise a frequency of output voices with respect to a frequency of the input voices, and the voice effect mode 2 is a mode for processing voices so as to lower a frequency of output voices with respect to a frequency of input voices. Furthermore, the voice effect mode 3 is a mode for processing voices so as to repeatedly change (sweep) a frequency of output voices continuously upward and downward.

A cancellation key 38 is provided between the display 20 and the music selection/pitch control keys 30 and 32. The cancellation key 38 is a key for canceling the tempo set by the tempo control keys 22 and 24, the BGM volume set by the volume control keys 26 and 28, the music number and the pitch set by the music selection/pitch control keys 30 and 32, the echo mode set by the echo mode selection key 34, and the voice effect mode set by the voice effect mode selection key 36. The cancellation key 38 is also used to suspend a music being played.

A determination key 39 is provided below the music selection/pitch control keys 30 and 32. The determination key 39 is a key for determining and validating the tempo set by the tempo control keys 22 and 24, the BGM volume set by the volume control keys 26 and 28, the music number and the pitch set by the music selection/the pitch control keys 30 and 32, the echo mode set by the echo mode selection key 34, and the voice effect mode set by the voice effect mode selection key 36.

An AV cable 40 is withdrawn from a lower portion of the body 12, i.e. from a lower end of the cylindrical portion, and the AV cable 40 includes two audio output terminals 42L and 42R and one video output terminal 44. The audio output terminals 42L and 42R and the video output terminal 44 are connected to an AV terminal of a home television (not shown). Therefore, the images or videos and the voices of the karaoke device with built-in microphone 10 in this embodiment are output on the home televisions. It is noted that when an audio circuit of the home television is not used, the audio output terminal 42L and 42R are connected to other audio devices such as a stereo amplifier or the like.

A cartridge connector 46 is provided on a rear surface of the body 12 as shown in FIG. 1(B), and a memory cartridge 48 is removably attached to the cartridge connector 46. It is possible to change a karaoke music and its images by changing the memory cartridge 48.

In addition, the karaoke device with built-in microphone 10 in this embodiment is driven by batteries. Due to this, a battery box 50 is provided at the lower cylindrical portion of the body 12 as shown in FIG. 1(B).

Figure 2:
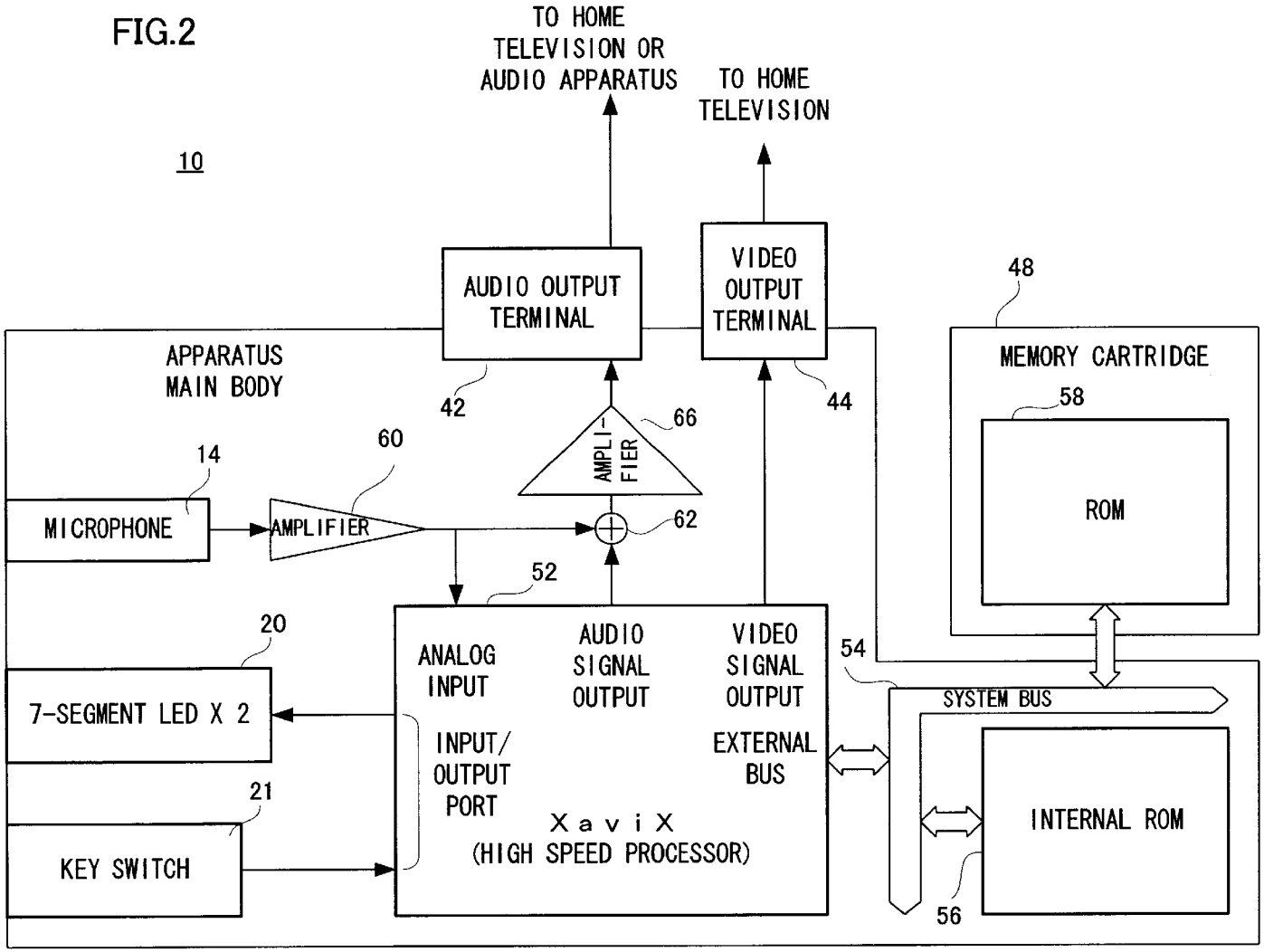
FIG. 2 is a block diagram showing one example of internal structure of FIG. 1 embodiment.

Referring to FIG. 2, the karaoke device with built-in microphone 10 in this embodiment includes a processor 52 accommodated inside the body 12. An arbitrary kind of processor can be utilized as the processor 52; however, in this embodiment a high-speed processor (trademark "XaviX") developed by the applicant of the present invention and already filed as a patent application is used. This high-speed processor is disclosed in detail in Japanese Patent Laying-open No.10-307790 [G06F 13/36, 15/78] and U.S. patent application Ser. No. 09/019,277 corresponding thereto.

Although not shown, the processor 52 includes various processors such as a CPU, a graphics processor, a sound processor, and a DMA processor and etc., and also includes an A/D converter used in fetching an analog signal and an input/output control circuit receiving an input signal such as a key operation signal and an infrared signal and giving an output signal to external devices. The CPU executes a required operation in response to the input signal, and gives results to the graphics processor and the sound processor. Therefore, the graphic processor and the sound processor execute an image processing and an audio processing according to the operation result.

A system bus 54 is connected to the processor 52, and an internal ROM 56 mounted on a circuit board (not shown) which is accommodated within the body 12 together with the processor 52 and an external ROM 58 included in the memory cartridge 48 are connected to the system bus 54. Therefore, the processor 52 can access to the ROMs 56 and the 58 through the system bus 54, and can retrieve a video or image data and music data (score data for playing musical instruments) and so on.

As shown in FIG. 2, the audio signal from the microphone 14 is supplied to an analog input of the processor 52 through an amplifier 60. An analog audio signal which is a result of the processing on the sound processor portion (not shown) of the processor 52 is output to the audio output terminals 42 (42L, 42R) shown in FIG. 1 through the mixer 62 and the amplifier 66. It is noted that a plurality of sound channels is formed in the sound processor portion. Furthermore, an analog image signal which is a result of the processing on the graphic processor (not shown) of the processor 52 is output to the video output terminal 44 shown in FIG. 1.

Furthermore, display data is applied from an output port of the processor 52 to the display 20 shown in FIG. 1, and all switches and keys shown in FIG. 1 (herein shown generally by reference number 21) are connected to the input port of the processor 52.

In the karaoke device with built-in microphone 10 in this embodiment, input singing voices (audio signal) are recognized on the basis of the musical scale data included in the musical score data, and a scoring is performed on the basis of the recognition result. Subsequently, scoring points earned as a result of the scoring is displayed on a home television in real time. Herein, the musical score data means data for playing a karaoke (BGM), and the musical scale data is data showing a musical scale of a melody of a lyrics and in synchronous with the musical score data. Because the musical score data and the musical scale data are in synchronous with each other, a tempo of the musical scale recognition is also changed if and when the reproduction temp of the musical score data is changed.

Figure 3:
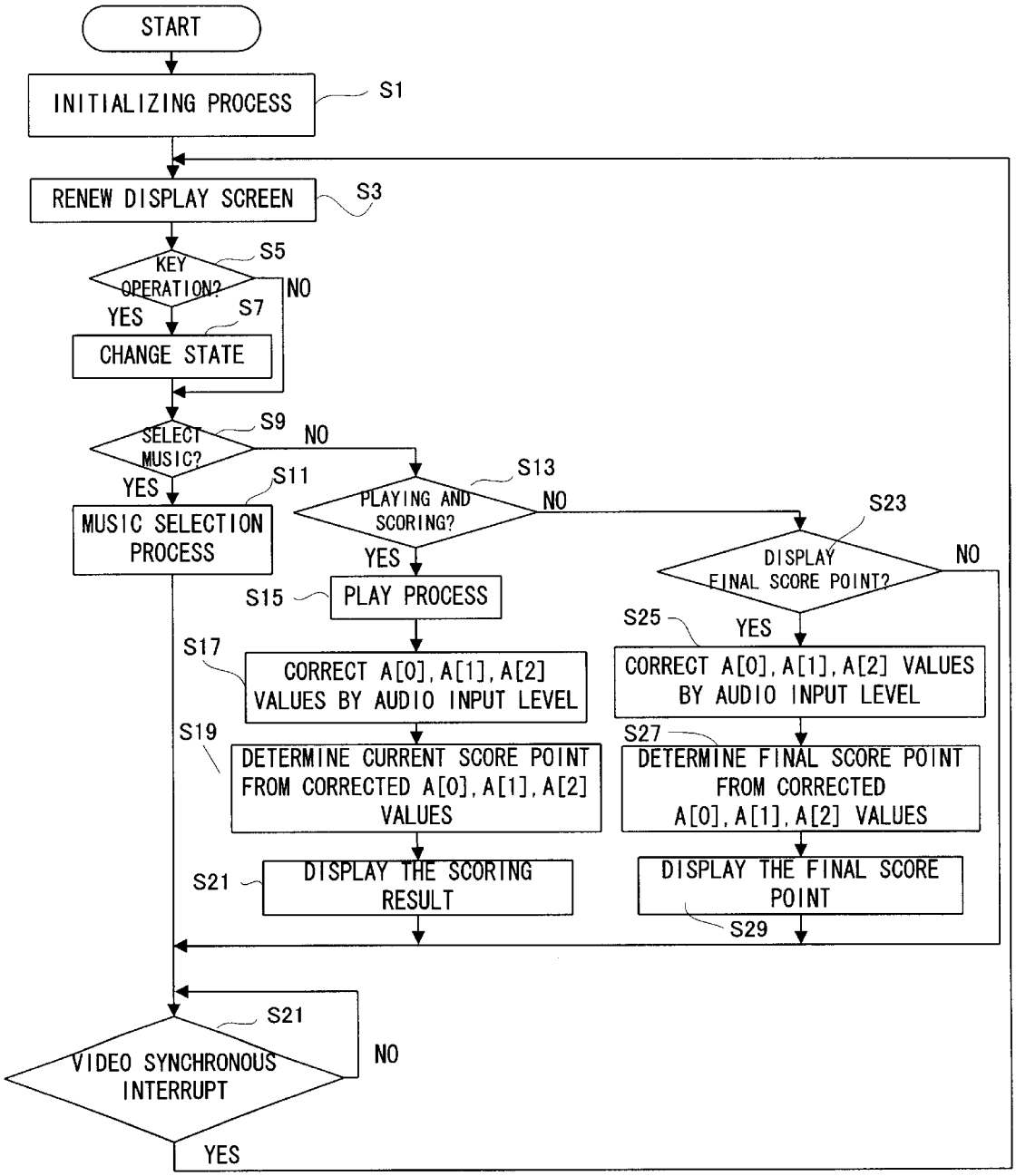
FIG. 3 is a flowchart describing a part of an operation of FIG. 1 embodiment.
Figure 4:
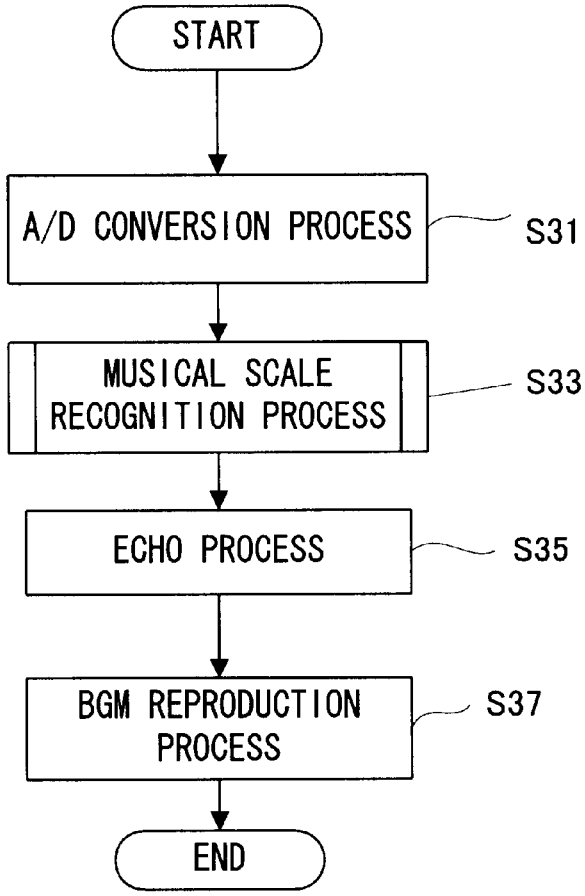
FIG. 4 is a flowchart describing another part of the operation of FIG. 1 embodiment.
Figure 5:
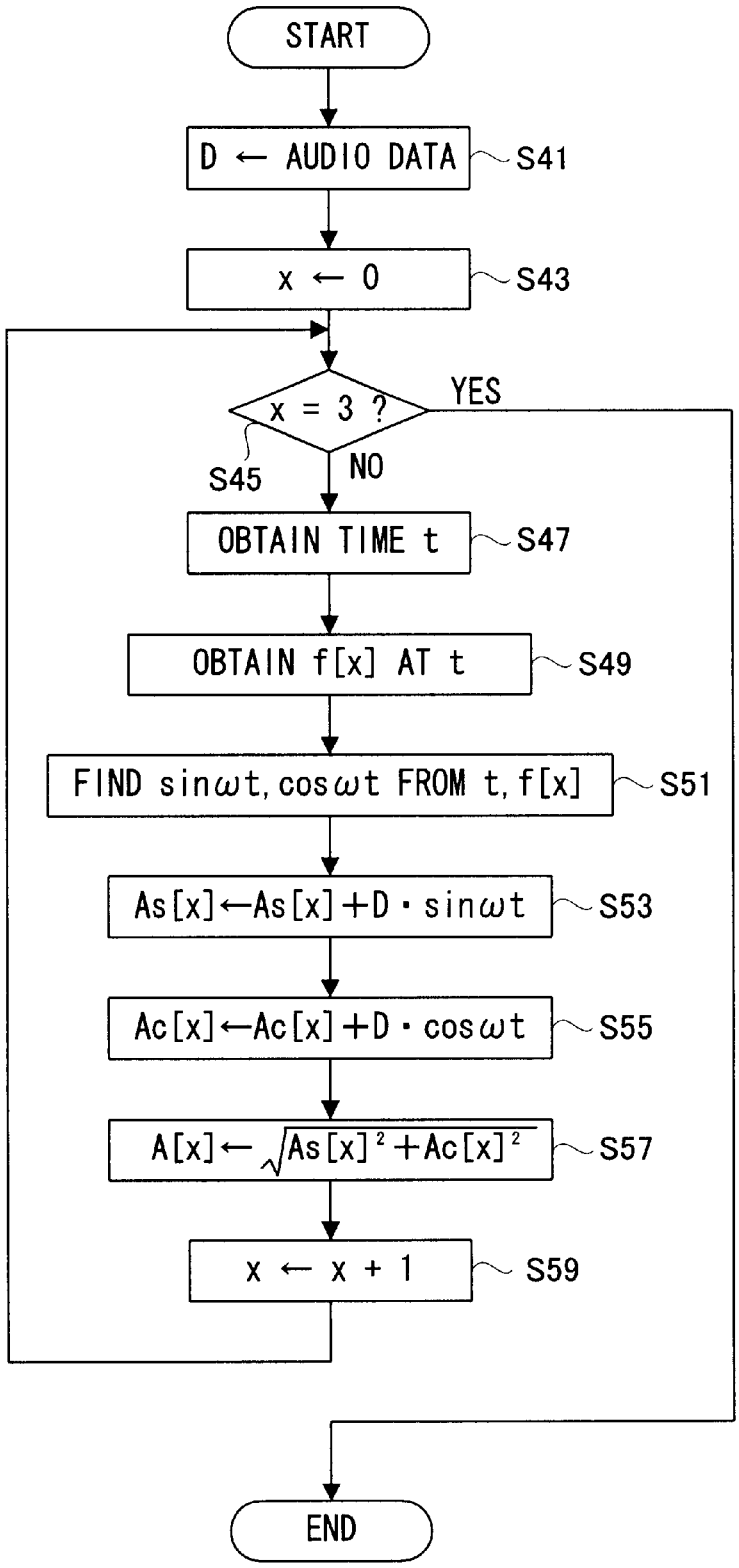
FIG. 5 is a flowchart describing a further part of the operation of FIG. 1 embodiment.

Descriptions are made below in regard to an operation of the processor 52 in the karaoke device with built-in microphone 10 by using FIGS. 3 to 5. It is noted that a routine shown in FIG. 3 is a routine executed constantly, and routines shown in FIG. 4 and FIG. 5 are a routine executed regularly due to a generation of a timer interrupt.

Immediately after the power switch 16 is turned on, an initializing process of the device is carried out in a step S1. Furthermore, a display screen of a home television to which the karaoke device with built-in microphone 10 is connected is renewed in a step S3. When the step S3 is executed first time, a title screen and the like of the karaoke device with built-in microphone 10 are displayed.

In a step S5 it is determined whether or not a key is operated. If and when it is determined that the key is operated, in a step S7 a state of the karaoke device with built-in microphone 10 is changed in response to a key operation.

In a case that a state is a music selection as a result of the state change in the step S7, that is, if and when the music selection keys 30 and 32 are operated, it is determined that the state is the music selection state in a step S9, and a music selection process is carried out in a step S11.

In a case that the state is music playing and scoring, i.e. a case that the determination key 39 is operated after the music selection, it is determined that the state is a playing and scoring state in a step S13, and a playing process is first carried out in a step S15. Furthermore, a scoring process is carried out in steps S17 and S19, and a process for displaying the scoring result on a home television screen is carried out in a step S21. Descriptions regarding the steps S17 and S19 are made after descriptions of a timer interrupt routine because A[0], A[1] and A[2] in the steps S17 and S19 are values calculated by the timer interrupt routine.

In a case that the state is a final scoring point displaying state, it is determined the state is the final scoring point displaying state in a step S23, and a final scoring process is carried out in steps S25 and S27. Then, a process for displaying the final scoring point on a home television screen is carried out in a step S29. It is noted that upon completion of a karaoke playing, the state becomes the final scoring point displaying state. Descriptions regarding the steps S25 and S27 are made after descriptions of a timer interrupt routine because A[0], A[1] and A[2] in steps S25 and S27 are values calculated by the timer interrupt routine.

In regard to the state, there are a tempo changing state, a reproduction volume changing state and the like are present in addition to the music selection state, the playing and scoring state and the final scoring point displaying state. However, the descriptions in regard thereto are omitted because these are not a primary part of the present invention.

Upon completion of the process in each state, it is determined whether or not a video synchronism interrupt is generated in the step S21. Subsequently, if and when a generation of the video synchronism interrupt is determined, the same process is carried out after returning to the step S3.

A routine executed upon a generation of the timer interrupt, as shown in FIG. 4 in a step S31, performs an A/D conversion of an input audio signal. Subsequently in a step S33 a musical scale recognition process is applied to the audio signal converted into digital data. The musical scale recognition in the step S33 is executed in accordance with a flowchart shown in FIG. 5.

Referring to FIG. 5, an amplitude of audio data is first substituted into a work area D in a step S41. It is noted that a value stored in the work area D is represented by a character D hereinafter. The same applies to other work areas. Next, "0" is substituted into a counter x in a step S43. Then, it is determined whether or not the value of the counter x is three (3) in a step S45. It is noted that the value of the counter x represented by a character x hereinafter. The same applies to other counters afterward.

If it is determined that the value of the counter x is not three (3), a current time t is obtained in a step S47. The time t is a time from a start of the playing (start of loading of the musical score data). Then, in a step S49 a musical scale of a musical note at the time t, i.e., a frequency which is a pitch of a sound, is obtained from the musical scale data included in the musical score data, and stored in a work area f[x]. Here, the frequency f[0] shows an unprocessed frequency of the musical note obtained from the musical score data, the frequency f[1] shows a frequency one octave below the frequency f[0] of the musical note obtained from the musical score data, and the frequency f[2] shows a frequency one octave above the frequency f[0] of the musical note obtained from the musical score data. A scoring is carried out by using three kinds of musical scales (frequencies) because it is thinkable that a song is sung on a musical scale one octave higher or lower depending on a singer.

In a step S51 sin ωt and cos ωt are calculated from the time t and the frequency f[x]. It may be also possible to find the sin ωt and cos ωt by referring to a previously prepared table. Herein, ω is an angular velocity corresponding to the frequency f[x].

In a step S53 an equation (6) is assigned to an array As[x], that is, a work area, and in a step S55 an equation (7) is assigned to an array Ac[x], that is, a work area.

$$As[x] \leftarrow AS + D \cdot \sin \omega t \tag{6}$$

$$Ac[x] \leftarrow AS + D \cdot \cos \omega t \tag{7}$$

It is noted that the array As[x] and the array Ac[x] have been initialized by assigning zero (0) to all elements at a time of a start of the karaoke playing. Furthermore, these arrays are initialized after a scoring evaluation in the step S19 shown in FIG. 3.

In addition, in a step S57 an equation (8) is assigned to an array A[x], that is, a work area.

$$A[x] \leftarrow \sqrt{As[x]^2 + Ac[x]^2} \tag{8}$$

Herein, A[x] indicates a level of consistency of the frequency (pitch or musical scale) of the input audio signal (singing voices) and the frequency (musical scale) f[x], and the larger the value, the higher the level of consistency. It is noted that "pitch", "musical scale" and "frequency" of sound (singing voices or music) are used as synonyms below. Note that in a case that a level of consistency of the audio signals using A[x] and the frequency f[x] is evaluated by assigning logarithmic weights instead of in a linear manner, it may assign the equation (9) instead of the equation (8) to the array A[x] in the step S57.

$$A[x] \leftarrow As[x]^2 + Ac[x]^2 \tag{9}$$

Then, the process returns to the step S45 after incrementing the counter x in a step S59, and the above described processes are repeated until the counter x becomes "3", i.e. a process of the musical scale one octave below and one octave above is completed. When the counter x becomes "3", the process returns to the routine in FIG. 4 by completing a subroutine shown in FIG. 5.

Furthermore, a predetermined echo process is applied to an output audio signal in a step S35, and a BGM (musical score data) reproduction process is carried out in a step S37. In this manner, the timer interrupt routine is terminated. It is noted that in the echo process, an output of the voices is included.

Now, descriptions are made in regard to the scoring process by returning to FIG. 3. In the scoring process in real time when a music (singing) is being played, each value of A[0], A[1], and A[2] is corrected by a sum of input levels of the audio signal in a step S17, and in a step S19 a current scoring point is determined on the basis of each value of the corrected A[0], A[1], and A[2]. In regard to a method of determination of the scoring point, it is conceivable a method wherein the largest value A[x] out of A[0], A[1], and A[2] is first determined, and then, the scoring point is determined on the basis of a ratio of the determined value of the A[x] and the value of A[x] at a time of full marks, or a method wherein weights are first assigned to A[0], A[1], and A[2], and then the scoring point is determined on the basis of a sum thereof.

Similarly, in the scoring process after the playing (singing) is ended in a step S25, each value of A[0], A[1], and A[2] is corrected by a sum of input levels of the audio signal. In a step S27 the current scoring point is determined on the basis of each value of the corrected A[0], A[1], and A[2].

As described above, in the karaoke device with built-in microphone 10 of this embodiment, the musical scale recognition is not carried out by applying FFT to the input voices as in a conventional manner but the musical scale recognition is carried out by comparing a specific frequency component (musical scale) expected to be input and the input voices. Therefore, it is possible to implement an apparatus capable of carrying out a musical scale recognition in real time by using a microprocessor with a low processing capability because a required processing is exceedingly simple, and in addition, a required amount of memory may be also extremely small.

[Second Embodiment]

Figure 6:
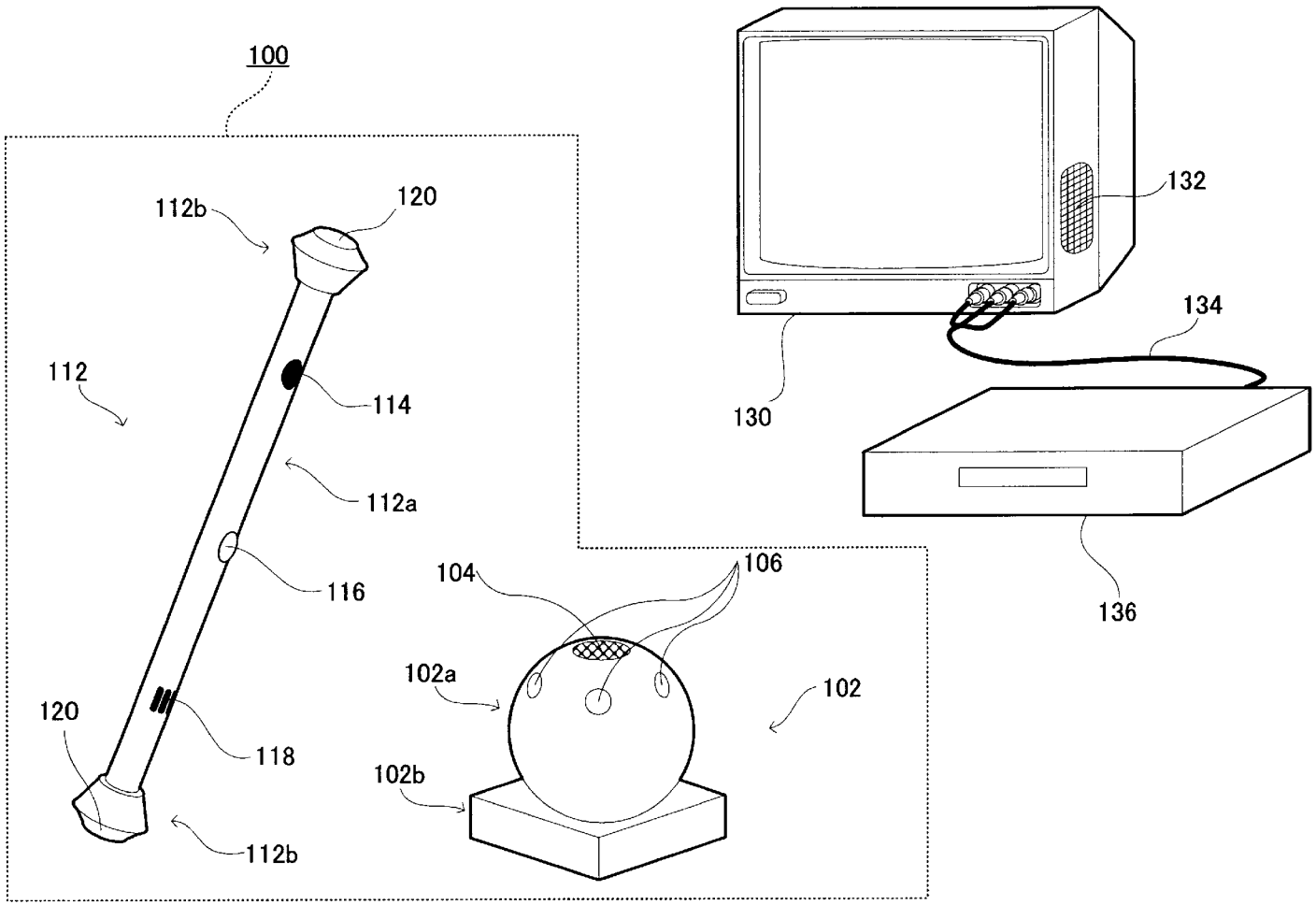
FIG. 6 is an illustrative view showing whole structure of another embodiment of the present invention.

Referring to FIG. 6, a toy 100 as a musical scale recognition apparatus in this embodiment includes a code transmission apparatus 102 and a code receiving apparatus 112.

The code transmission apparatus 102 includes an upper housing 102*a* having a spherical shape and a lower housing 102*b* having a box shape, and a microphone 104 is attached on an upper end of the upper housing 102*a*. At an approximately upper end side from a center of the upper housing 102*a*, four (4) infrared light-emitting diodes 106 are provided at a position which equally divides the surface circumference into four parts. It is noted that only three (3) infrared light-emitting diodes 106 are illustrated in this drawing.

Figure 7:
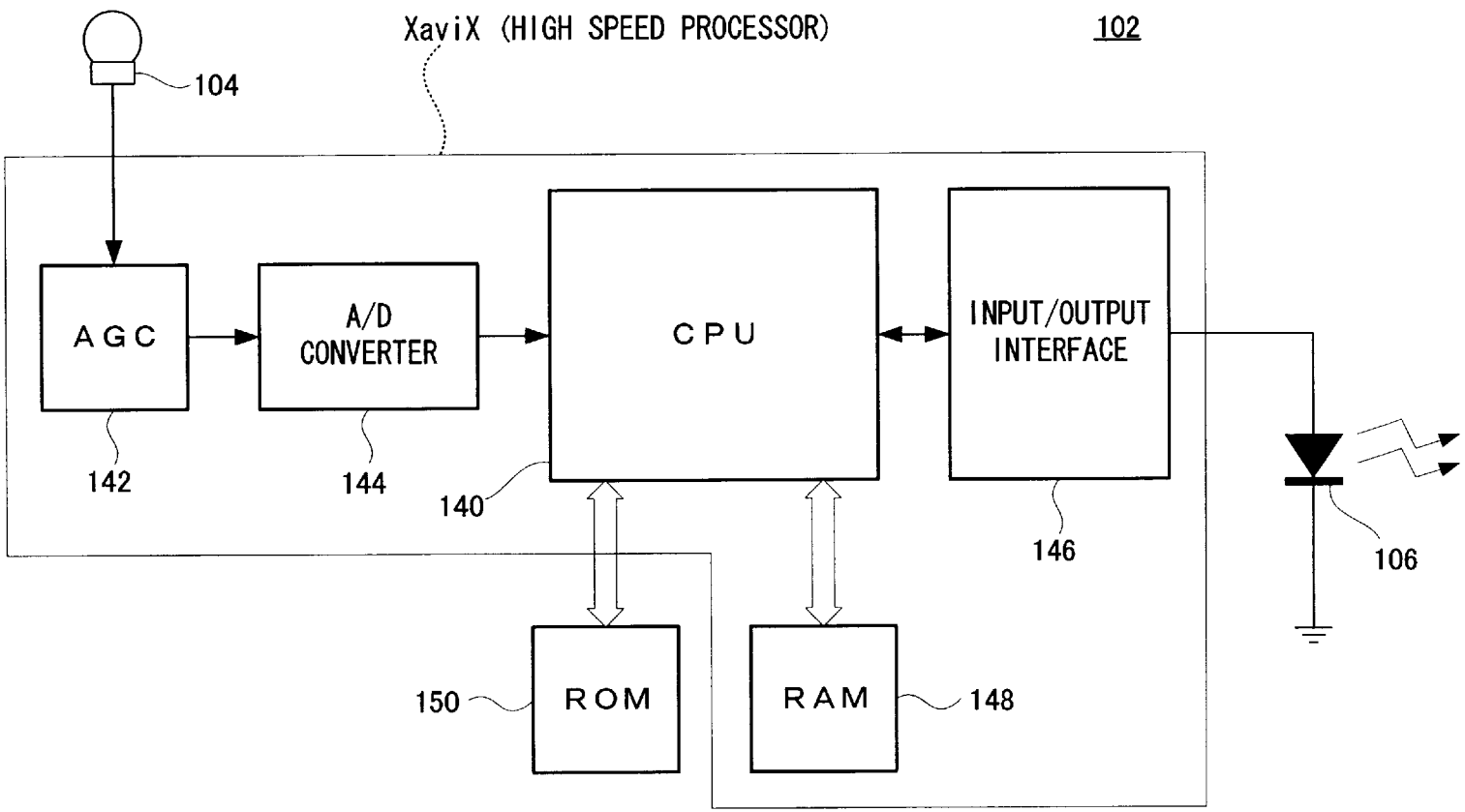
FIG. 7 is a block diagram showing one example of a part of internal structure of FIG. 6 embodiment.

The code transmission apparatus 102 is formed, more specifically, as shown in FIG. 7. The microphone 104 is connected to a CPU 140 via an AGC 142 and an A/D converter 144. In addition, the infrared light-emitting diodes 106 are connected to the CPU 140 via an input/output interface 146. Furthermore, the CPU 140 is connected to a RAM 148 and a ROM 150, and capable of writing and reading data to and from the RAM 148 and the ROM 150. It is noted that as to the CPU 142, the AGC 142, the A/D converter 144, the input/output interface 146 and the RAM 148, the above mentioned XaviX (trademark) may be applied.

Referring to FIG. 6, the code receiving apparatus 112 includes a middle portion 112*a* of a stick shape and end portions 112*b* which are almost like diamond or lozenge shape provided at both ends of the middle portion 112*a*. At an end side of each end portion 112*b* LEDs 120 are provided. In the vicinity of the center of the middle portion 112*a* a key switch 116 is provided. In addition, on a side of one end portion 112*b* from the key switch 116 an infrared light receiving module 114 is provided, and on a side of the other end portion 112*b* from the key switch 116 a speaker 118 is provided.

Figure 8:
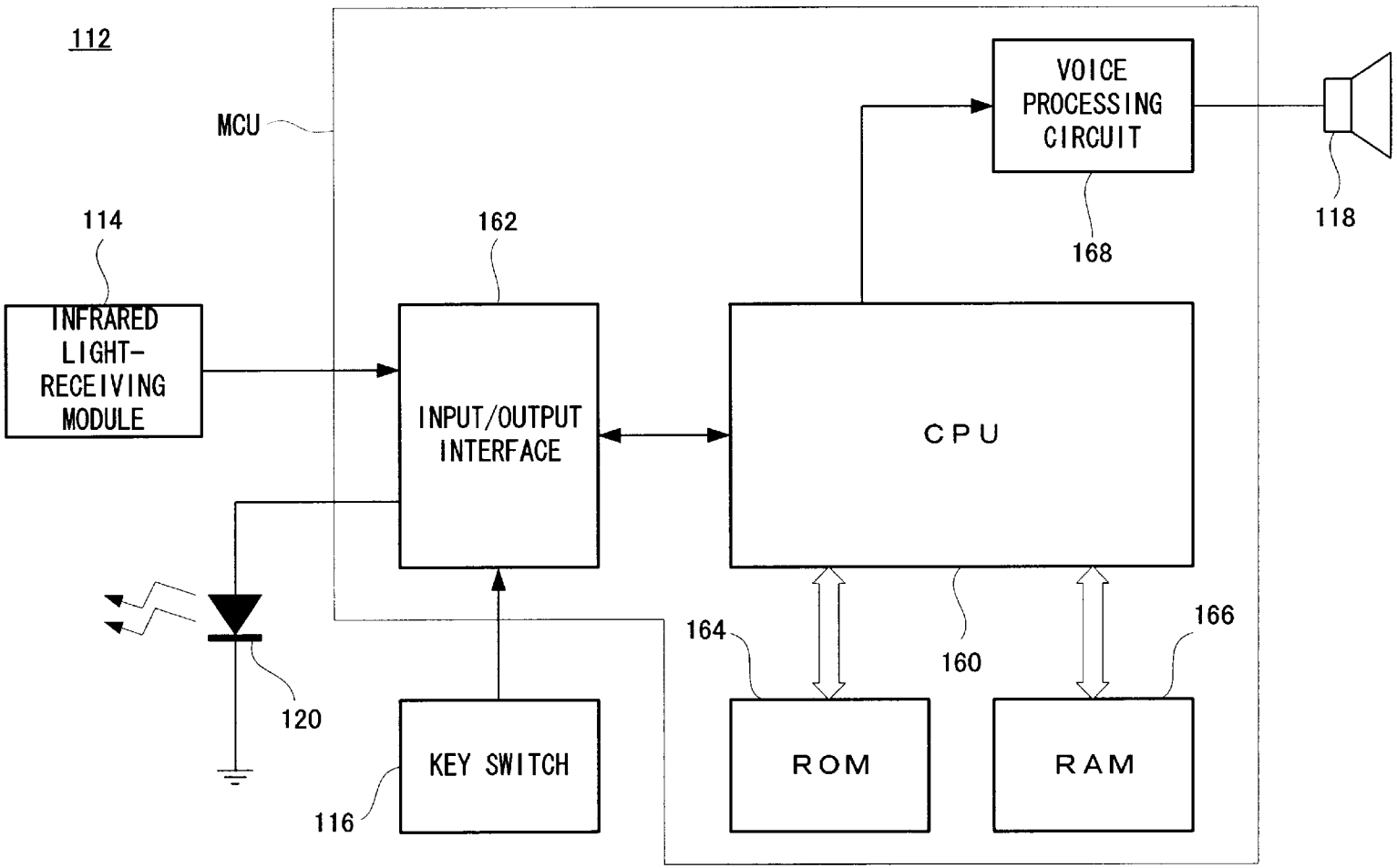
FIG. 8 is a block diagram showing one example of another part of internal structure of FIG. 6 embodiment.

The code receiving apparatus 112 is formed, more specifically, as shown in FIG. 8. The infrared light-receiving module 114, the LEDs 120 and the key switch 116 are connected to the CPU 160 via an input/output interface 162. Furthermore, the speaker 118 is connected to the CPU 160 via a voice processing circuit 168. In addition, the ROM 164 and the RAM 166 are connected to the CPU 160, and a data transfer to or from the ROM 164 and the RAM 166 is made possible. It is noted that a single-chip MCU (micro controller unit) may be used for the input/output interface 162, the ROM 164, the RAM 166 and the voice processing circuit 168.

Referring to FIG. 6, in the toy 100 of this embodiment a musical scale of voices on a television program output from a speaker 132 of a home television 130 is recognized by the code transmission apparatus 102, and it is determined with which plurality of phrases previously prepared the recognized voices are coincident. Subsequently, the code corresponding to the coincident phrase is transmitted by blinking the infrared light-emitting diode 106. In the code receiving apparatus 112, the infrared light-receiving module 114 receives the infrared code transmitted from the code transmission apparatus 102, and the LED 120s are blinked and the voices from the speaker 118 are output on the basis of the received code. It is noted that the voices output from the speaker 132 are not necessarily voices of a television program. It may be possible, for example, that a video deck 136 is connected to an AV terminal of the home television 130 by using a cable 134, and a video software is then reproduced by the video deck 136 and the voices recorded in the video software are output from the speaker 132.

Descriptions are made below in regard to an operation of the CPU 140 of the code transmission apparatus 102 by using FIGS. 9 to 11, and descriptions are then made in regard to an operation of the CPU 160 of the code receiving apparatus 112 by using FIG. 12.

Figure 9:
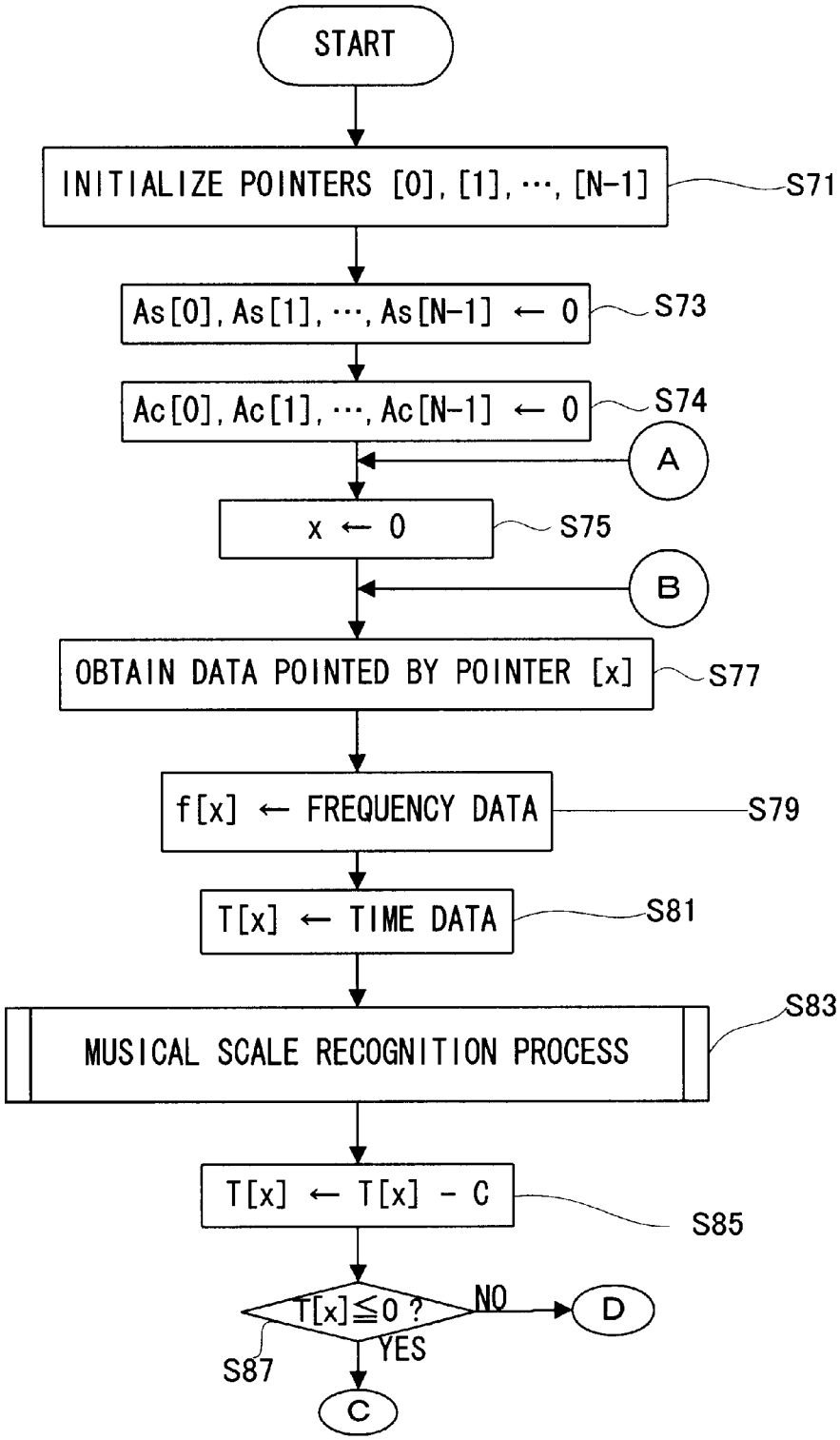
FIG. 9 is a flowchart describing a part of an operation of FIG. 6 embodiment.

First, in a step S71 in FIG. 9, pointers [0], [1], [1], . . . , [N−1] are initialized. In this embodiment, phrases in N unit are prepared in advance, and each pointer [0], [1], . . . , [N−1] is a pointer pointing each of N phrases. Furthermore, if and when the pointers [0], [1], . . . , [N−1] are initialized, each pointer points a head musical note of each phrase. In addition, if and when the pointer is incremented, a next musical note within the phrase is pointed.

In a step S73, an initialization is carried out by assigning "0" to work areas As[0], As[1], . . . , As[N−1], and in a step S74 an initialization is carried out by assigning "0" to work areas Ac[0], Ac[1], . . . , Ac[N−1]. The work area As[0], As[1], . . . , As[N−1] are work areas for storing cumulative values to find a coefficient of a Fourier sine series. As[0] stores a value regarding a recognition of a relevant musical note of the first phrase, As[N−1] stores a value regarding a recognition of a relevant musical note of the N-th phrase. In a similar manner, the work areas Ac[0], Ac[1], . . . , Ac[N−1] are work areas for storing cumulative values to find a coefficient of a Fourier cosine series. Ac[0] stores a value regarding a recognition of a relevant musical note of the first phrase, Ac[N−1] stores a value regarding a recognition of a relevant musical note of the N-th phrase. In a step S75 an initialization is carried out by assigning "0" to the counter x.

In a step S77 data pointed by the pointer [x] is obtained. The data obtained at this time are frequency data of the musical note pointed by the pointer [x] and time (length) data of the musical note. It is noted in a case of x=0, the current pointer [x] points any one of musical notes of the first phrase. In a step S79 the frequency data obtained is assigned to the work area f[x], and the obtained time data is assigned to the work area T[x].

Subsequently, a musical scale recognition processing is carried out in a step S83. The musical scale recognition processing is executed according to a flowchart shown in FIG. 11. First in a step S111, an amplitude of an audio signal (A/D converted audio data) output from the speaker 132 of the home television 130 is assigned to the work area D.

Next a current time t is obtained in a step S113, and sin ωt and cos ωt are evaluated from the time t and the frequency f[x] in a step S115. The ω is an angular velocity in corresponce to the frequency f[x]. It is noted that it may be also possible to find sin ωt and cos ωt by referring to a table being prepared in advance.

In a step S117 the above equation (6) is assigned to As[x], and the above equation (7) is assigned to Ac[x] in a step S119. Furthermore, the above equation (8) is assigned to A[x] in a step S121.

Herein, A[x] shows a degree of coincidence between a pitch of the input audio signal (singing voices) and the frequency f[x], and the larger the value, the higher the degree. In addition, in a case that a level or degree of consistency of the audio signals using A[x] and the frequency f[x] is evaluated by assigning logarithmic weights instead of in a linear manner, it may assign the equation (9) instead of the equation (8) to the A[x] in the step S121.

Upon completion of a musical scale recognition processing in the step S83 (FIG. 9), a predetermined time C is subtracted from T[x] in a step S85. It is noted that the time C is a time coincident with a time interval of the A/D conversion process of the input voices. In addition, in a step S87 it is determined whether or not T[x] is negative, i.e. whether or not a time equal to a length of the musical note has lapsed. Subsequently, if it is determined that the time t[x] has not lapsed, the process proceeds to a step S105 to increment the counter x. In other words, the musical note of the next phrase is recognized by reserving the recognition of the relevant musical note of the relevant phrase.

Figure 10:
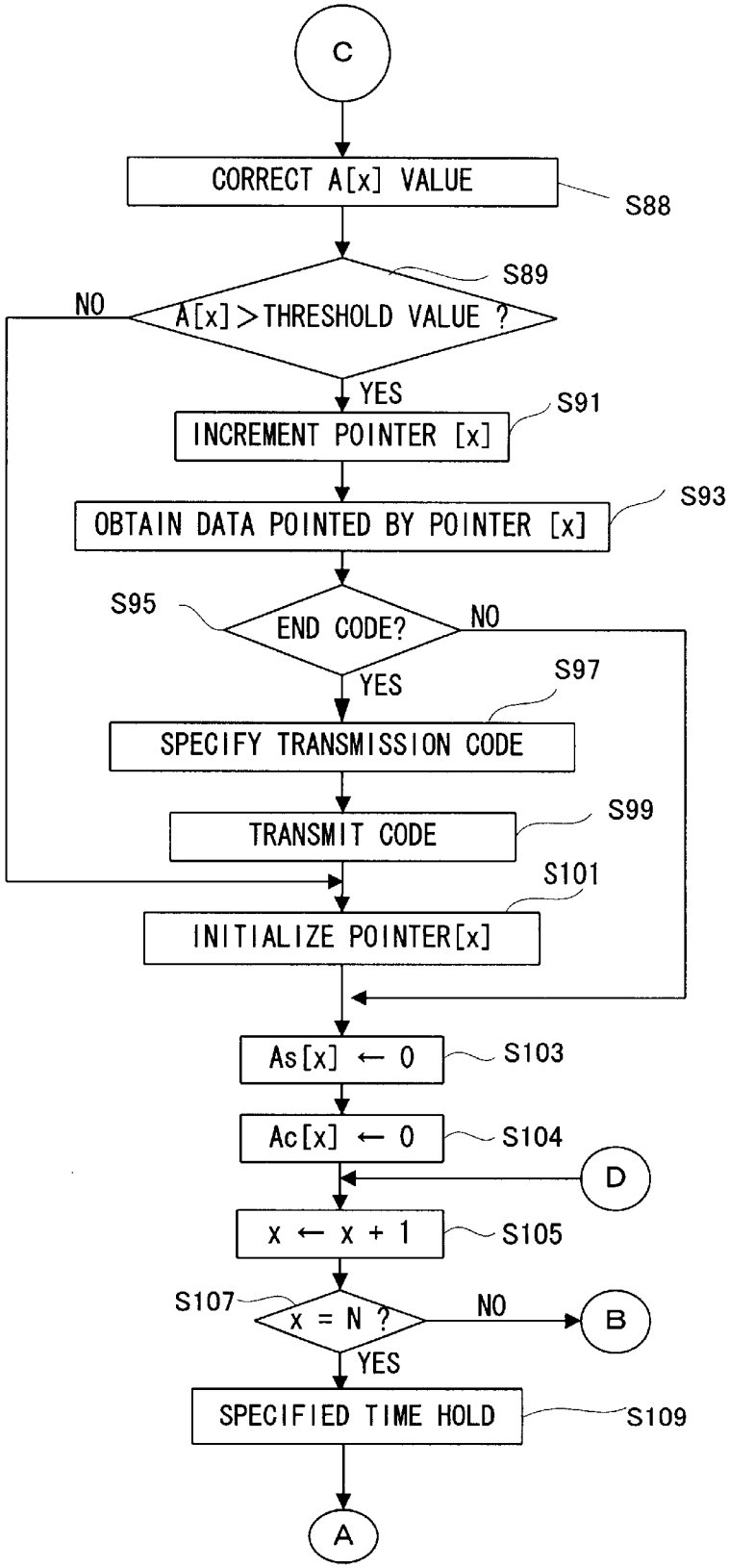
FIG. 10 is a flowchart describing another part of the operation of FIG. 6 embodiment.
Figure 11:
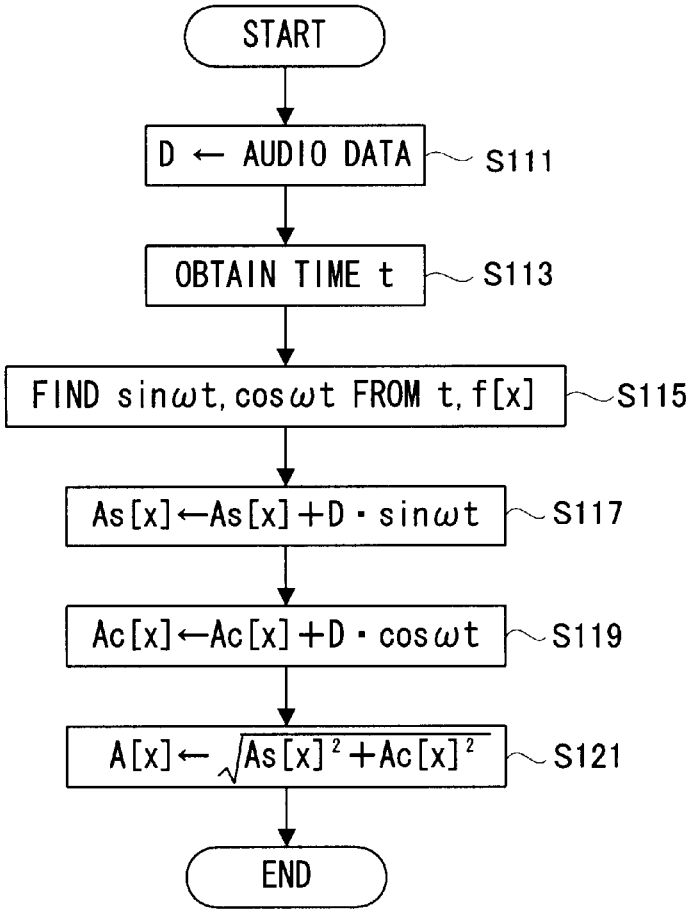
FIG. 11 is a flowchart describing a further part of the operation of FIG. 6 embodiment.

If it is determined that the time t[x] has lapsed in the step S87, a value of A[x] is corrected in accordance with the amplitude level of the input voices in a step S88 shown in FIG. 10. Then, it is determined whether or not A[x] is larger than a given threshold value in a step S89. If and when it is determined that the value of A[x] is smaller than the threshold value, the process proceeds to a step S101 to initialize the pointer [x]. In other words, the pointer of the relevant phrase is returned to the head musical note on ground of not being coincident with the relevant phrase. Then, an initialization is carried out by assigning "0" to As[x] in a step S103, and an initialization is carried out by assigning "0" to Ac[x] in a step S104. Furthermore, the counter x is incremented in a step S105, and the process proceeds to a processing of the next phrase.

If and when it is determined that A[x] is larger than the threshold value in the step S89, the pointer [x] is incremented in a step S91, such that a next musical note of the relevant music note of the relevant phrase is pointed, and data pointed at by the pointer [x] is obtained in a step S93. An end code is provided at an end of each phrase, and in a step S95, it is determined whether or not the data pointed at by the pointer [x] is the end code. In a case of the end code, this means that the input audio signal is coincident with the relevant phrase, and the code corresponding to the relevant phrase is specified in a step S97. Furthermore, in a step S99 the code corresponding to the relevant phrase is transmitted by blinking the infrared light-emitting diode 120. Then, in a step S101 the pointer [x] is initialized. Furthermore, an initialization is carried out by assigning "0" to As[x] in a step S103, and an initialization is carried out by assigning "0" to Ac[x] in a step S104. Moreover, the counter x is incremented in a step S105, and the process proceeds to a processing of the next phrase.

In case it is determined the data is not the end code in the step S95, this means that the input voices are coincident with the relevant phrase on its way to a certain relevant musical note, and the next phrase is processed by proceeding to a step S103 or the following steps because it is still not certain whether or not the input voices are coincident with the relevant phrase up to the end. In the step S103 an initialization is carried out by assigning "0" to As[x], and in a step S104 an initialization is carried out by assigning "0" to Ac[x]. Furthermore, the counter x is incremented in the step S105. In addition, in a step S107 it is determined whether or not a value of the counter x is N, that is, a confirmation of the musical note included in the N-th phrase is completed. If and when it is determined that the value of the counter x is not N, the process returns to the step S77 in order to confirm the musical tone is included in the (x+1)th phrase.

If and when it is determined that value of the counter x is N in the step S107, in a step S109 a predetermined time period is put on hold, and thereafter, the process returns to the step S75. In the step S75 an initialization is carried out by making the value of the counter x "0". That is, a recognition process of the musical note included in the first phrase is once again performed.

In this manner, the CPU 140 of the code transmission apparatus 102 confirms with which phrases in N units previously prepared the input audio signal is coincident. At this time, it is confirmed that a musical scale of every one of notes included in the audio signal is coincident with which every one of musical tones included in phrases in N units. This process is carried out in order to confirm the first musical tone of the first phrase, the second musical tone of the second phrase, . . . , the N-th musical tone of the N-th phrase, the second musical tone of the first phrase, the second musical tone of the second phrase, and so on. In addition, if and when the input audio signal is coincident with a certain phrase, the code corresponding to the phrase is transmitted as an infrared signal.

Figure 12:
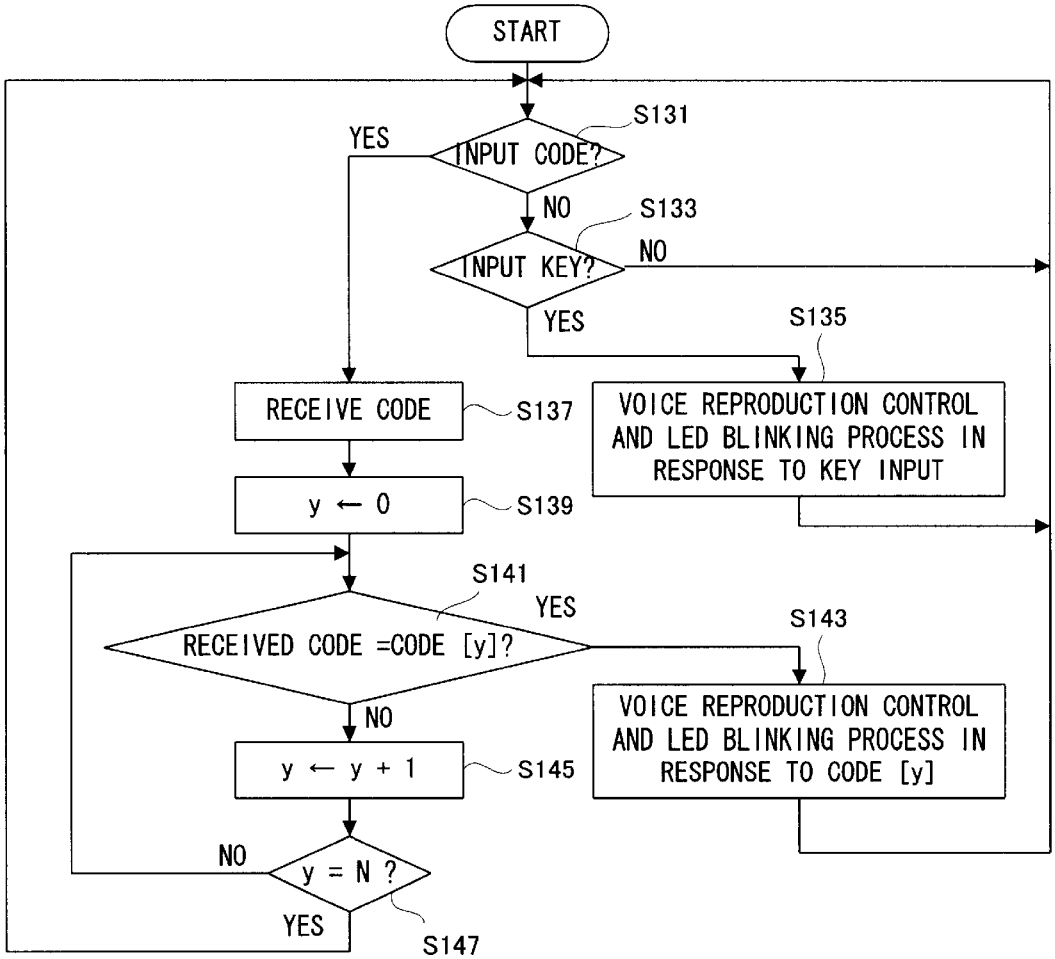
FIG. 12 is a flowchart describing another part of the operation of FIG. 6 embodiment.

Next, descriptions are made in regard to an operation of the CPU 160 of the code receiving apparatus 112 by referring to FIG. 12. If and when a code is transmitted from the code transmission apparatus 102 as the infrared signal, it is then determined that the code input is present in a step S131, and the code is received in a step S137.

In a step S139 an initialization is carried out by assigning "0" to a counter y. Then, in a step S141 it is determined whether or not a received code is coincident with a code [y]. The code [y] in N units equal to the number N of the phrase is prepared, and it is determined whether or not the received code is coincident with code [y]. If and when it is determined that the received code and the code [y] with each other are coincident in a step S143, voices corresponding to the code [y] are output from the speaker 118, and at the same time the LEDs 120 are caused to blink with a rhythm corresponding to the code [y].

If and when it is determined that the received code and the code [y] are not coincident with each other, the counter y is incremented in a step S145, and it is determined whether or not the value of the counter y is N in a step S147. If and when the value of the counter y is not N, the process returns to the step S141 and determines whether or not the received code is coincident with a next code [y]. On the other hand, if and when it is determined that the value of the counter y is N in the step S147, the process returns to the step S131 because there is no code [y] coincident with the received code.

In addition, if and when the key switch 116 is pressed by a user, it is determined that there is a key input in a step S133, and in a step S135 voices corresponding to the key input are output from the speaker 118, and at the same time the LEDs 120 are caused to blink with a rhythm corresponding to the key input.

In this manner, the phrase output from the speaker 132 of the television 130 is recognized by the code transmission apparatus 102, and the code corresponding to the recognized phrase is transmitted. The transmitted code is received by the code receiving apparatus 112, and the sound corresponding to the received code is output from the speaker 118, and at the same time the LEDs 120 are caused to blink with a rhythm corresponding to the received code. Therefore, the sound is output from the code receiving apparatus and the LEDs blink in accordance with the phrase output from the speaker 132 of the home television 130.

In the past, there were apparatuses having an optical sensor, which performs operation, e.g. a reproduction of a sound effect, a blinking of an LED and the like when an entire television screen is blinked at specific intervals. However, in such apparatuses, there was a health concern that a blinking television screen would cause a health problem to viewers having a symptom, e.g. optical hypersensitivity or the like. There was no such concern with the toy 100 in this embodiment.

As described above, unlike in the past the toy 100 in this embodiment does not carry out a musical scale recognition by specifying a primary frequency component by applying FTT to input voices, but the musical scale recognition is carried out by comparing a specific frequency component (musical scale) expected to be input and input voices. Therefore, a required processing is considerably simple, and a required amount of memory can be greatly reduced. Due to this, it is possible to implement an apparatus capable of carrying out a musical scale recognition in real time by a microprocessor with a low processing capability.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A musical scale recognition method, comprising following steps of:

(a) sampling an input analog audio signal at a constant time interval C and converting into digital data D;

(b) deriving sin ωt and cos ωt (ω is an angular velocity corresponding to an observed frequency f) based upon the observed frequency f and a time t;

(c) making an operation of an equation (1) and calculating a cumulative value As to find a coefficient of Fourier sine series;

$$As \leftarrow As + D \cdot \sin \omega t \quad (1)$$

(d) making an operation of an equation (2) and calculating a cumulative value Ac to find a coefficient of Fourier cosine series;

$$Ac \leftarrow Ac + D \cdot \cos \omega t \quad (2)$$

(e) making an operation of an equation (3) and calculating a frequency power spectrum effective value;

$$A \leftarrow \sqrt{As^2 + Ac^2} \quad (3)$$

(f) evaluating a component of said frequency f included in said analog audio signal on the basis of said numeric value A; and (g) making an operation of an equation (4) and renewing said time t;

$$t \leftarrow t + C \quad (4)$$

2. A musical scale recognition method, comprising following steps of:

(a) sampling an input analog audio signal at a constant time interval C and converting into digital data D;

(b) deriving sin ωt and cos ωt (ω is an angular velocity corresponding to an observed frequency f) based upon the observed frequency f and a time t;

(c) making an operation of an equation (1) and calculating a cumulative value As to find a coefficient of Fourier sine series;

$$As \leftarrow As + D \cdot \sin \omega t \quad (1)$$

(d) making an operation of an equation (2) and calculating a cumulative value Ac to find a coefficient of Fourier cosine series;

$$Ac \leftarrow Ac + D \cdot \cos \omega t \quad (2)$$

(e) making an operation of an equation (5) and calculating a frequency power spectrum effective value, $$A \leftarrow As^2 + Ac^2 \quad (5)$$

(f) evaluating a component of said frequency f included in said analog audio signal on the basis of said numeric value A; and (g) making an operation of an equation (4) and renewing said time t;

$$t \leftarrow t + C \quad (4)$$

3. A method according to any of claim 1 or 2, wherein step (f) includes a step (f1) which corrects said numeric value A in correspondence with a level of an amplitude of said analog audio signal.

4. A method according to any of claim 1 or 2, wherein respective steps from (b) to (f) are carried out in regard to a plurality of observation frequencies ($f_0$, $f_1$, . . . , $f_{N-1}$: N is the number of units of the frequency simultaneously observed).

5. A musical scale recognition apparatus, comprising:

an analog/digital converting means which applies a sampling to the input analog audio signal at a constant time interval C and converts into digital data;

a deriving means which derives sin ωt and cos ωt (ω is an angular velocity corresponding to an observed frequency f) based upon the observed frequency f and a time t;

a first calculating means which makes an operation of an equation (1) and calculating a cumulative value As to find a coefficient of Fourier sine series;

$$As \leftarrow As + D \cdot \sin \omega t \quad (1)$$

a second calculating means which makes an operation of an equation (2) and calculating a cumulative value Ac to find a coefficient of Fourier cosine series;

$$Ac \leftarrow Ac + D \cdot \cos \omega t \quad (2)$$

a third calculating means which makes an operation of an equation (3) and calculating a frequency power spectrum effective value;

$$A \leftarrow \sqrt{As^2 + Ac^2} \quad (3)$$

an evaluating means which evaluates a component of said frequency f included in said analog audio signal on the basis of said numeric value A; and a renewing means which makes an operation of an equation (4) and renewing said time t;

$$t \leftarrow t + C \quad (4)$$

6. A musical scale recognition apparatus, comprising:

an analog/digital converting means which applies a sampling to the input analog audio signal at a constant time interval C and converts into digital data;

a deriving means which derives sin ωt and cos ωt (ω is an angular velocity corresponding to an observed frequency f) based upon the observed frequency f and a time t;

a first calculating means which makes an operation of an equation (1) and calculating a cumulative value As to find a coefficient of Fourier sine series;

$$As \leftarrow As + D \cdot \sin \omega t \quad (1)$$

a second calculating means which makes an operation of an equation (2) and calculating a cumulative value Ac to find a coefficient of Fourier cosine series;

$$Ac \leftarrow Ac + D \cdot \cos \omega t \quad (2)$$

a third calculating means which makes an operation of an equation (5) and calculating a frequency power spectrum effective value;

$$A \leftarrow As^2 + Ac^2 \quad (5)$$

an evaluating means which evaluates a component of said frequency f included in said analog audio signal on the basis of said numeric value A; and a renewing means which makes an operation of an equation (4) and renewing said time t;

$$t \leftarrow t+C \quad (4)$$

7. An apparatus according to any of claim 5 or 6, wherein said evaluating means includes a correcting means which corrects said numeric value A in correspondence to a level of an amplitude of said analog audio signal.

8. An apparatus according to any of claim 5 or 6, wherein said first calculating means, said second calculating means, said third calculating means and said evaluating means perform an operation of each of a plurality of observation frequencies ($f_0, f_1, \ldots, f_{N-1}$: N is the number of units of the frequency simultaneously observed).

9. A musical recognition apparatus according to claim 8, further comprising:

a BGM reproducing means which reproduces a karaoke BGM on the basis of musical score data;

a musical score data storing means which stores said musical score data and musical scale data of an exemplary melody for a singing included in synchronous with said musical score data;

a reading means which reads said musical scale data from said musical score data storing means at said time t;

a setting means which sets a frequency of said musical scale data read by said reading means to observed frequency $f_0$, a frequency of a musical scale one octave below said musical scale data read by said reading means to said observed frequency $f_1$, and a frequency of a musical scale one octave above said musical scale data read by said reading means to said observed frequency $f_2$;

a musical scale recognition means which carries out a musical recognition by using a predetermined musical scale recognition method; and an outputting means which outputs an evaluation result by said evaluation means.

10. A musical scale recognition apparatus according to claim 5 or 6, further comprising:

a musical scale recognition means which sequentially carries out a musical scale recognition of said analog audio signal by using a predetermined musical recognition method;

a comparing means which compares a changing pattern of a musical scale recognized by said musical scale recognition means with a predetermined musical phrase; and a first operating means which operates a predetermined operation brought into correspondence to a relevant musical phrase when a changing pattern of a musical scale recognized by said musical recognition means as a result of a comparison by said comparing means is coincident with said predetermined musical phrase.

11. A musical scale recognition apparatus according to claim 5 or 6, further comprising:

a musical note data storing means which stores a musical scale data of each musical note of a musical phrase;

a pointer which points at one of musical note data stored in said musical note data storing means;

a musical note data reading means which reads a musical scale data of a musical note pointed by said pointer from musical note data storing means;

a setting means which sets frequency of a musical scale data read by said musical note data reading means to said observed frequency f;

a musical scale recognition means which sequentially carries out a musical scale recognition of said analog audio signal by using a predetermined musical recognition method;

a comparing means which compares a degree of a frequency component of said frequency f included in said analog audio signal with a predetermined threshold value;

a pointer manipulating means which increments said pointer when the degree of the frequency component of said frequency f included in said analog audio signal is larger than said predetermined threshold value as a result of a comparison result by said comparing means so as to point musical scale data of a forefront musical note of said musical phrase by said pointer when the degree of the frequency component of said frequency f included in said analog audio signal is below said predetermined threshold value; and a first operating means which carries out a predetermined operation brought into correspondence to a relevant musical phrase when a value of said pointer exceeds a position of a musical scale data of an end musical note of said musical phrase.

12. An apparatus according to claim 11, wherein said musical note data storing means further stores a reproduction time data of said each musical note, further comprising a reproduction time data reading means which reads said reproduction time data of said musical note pointed by said pointer from said musical note data storing means, wherein said musical scale recognition means applies a musical scale recognition to a frequency of said musical scale data during a period shown by said reproduction time data read by said reproduction time data reading means.

13. An apparatus according to claim 10, wherein said first operating means includes a code transmission means which transmits a code brought into correspondence to said musical phrase.

14. An apparatus according to claim 13, wherein said code transmission means transmits a code brought into correspondence to said musical phrase by blinking an infrared light-emitting element.

15. An apparatus according to claim 13, further comprising a code receiving means which receives said code transmitted by said code transmission means; and a second operating means which carries out a predetermined operation brought into correspondence to said code received by said code receiving means.

16. An apparatus according to claim 15, wherein said second operating means includes a light-emitting element and a light-emitting element blinking means which causes said light-emitting element to blink with a predetermined pattern.

17. An apparatus according to claim 15, wherein said second operating means further includes a speaker and a voice outputting means which outputs a predetermined voice pattern from said speaker.

18. An apparatus according to claim 10, wherein said analog audio signal is an audio signal included in a television program and output from a home television receiver.

19. An apparatus according to claim 10, wherein said analog audio signal is an audio signal stored in a recording medium and output from a reproduction device of said recording medium.

20. An apparatus according to claim 11, wherein said first operating means includes a code transmission means which transmits a code brought into correspondence to said musical phrase.

21. An apparatus according to claim 20, wherein said code transmission means transmits a code brought into correspondence to said musical phrase by blinking an infrared light-emitting element.

22. An apparatus according to claim 20, further comprising a code receiving means which receives said code transmitted by said code receiving means; and a second operating means which carries out a predetermined operation brought into correspondence to said code received by said code transmission means.

23. An apparatus according to claim 22, wherein said second operating means includes a light-emitting element and a light-emitting element blinking means which causes said light-emitting element to blink with a predetermined pattern.

24. An apparatus according to claim 22, wherein said second operating means further includes a speaker and a voice outputting means which outputs a predetermined voice pattern from said speaker.

25. An apparatus according to claim 11, wherein said analog audio signal is an audio signal included in a television program and output from a home television receiver.

26. An apparatus according to claim 11, wherein said analog audio signal is an audio signal stored in a recording medium, and output from a reproduction device of said recording means.

* * * * *